United States Patent [19]

Gardner et al.

[11] 4,388,813

[45] Jun. 21, 1983

[54] SERVER FOR WINE BOTTLES AND THE LIKE

[75] Inventors: James H. Gardner; Noel H. de Nevers, both of Salt Lake City, Utah

[73] Assignee: Aurora Design Associates, Inc., Salt Lake City, Utah

[21] Appl. No.: 330,556

[22] Filed: Dec. 14, 1981

Related U.S. Application Data

[63] Continuation of Ser. No. 171,901, Jul. 24, 1980, abandoned, which is a continuation-in-part of Ser. No. 61,655, Jul. 30, 1979, Pat. No. 4,255,944.

[51] Int. Cl.[3] ..... F25D 3/08

[52] U.S. Cl. ..... 62/457; 62/371

[58] Field of Search ..... 62/371, 372, 457, 529, 62/530

[56] References Cited

U.S. PATENT DOCUMENTS

| | | | |
|---|---|---|---|
| 1,858,728 | 5/1932 | Creighton | 62/457 X |
| 1,999,670 | 4/1935 | Strouse et al. | 62/372 |
| 2,838,916 | 6/1958 | Sola | 62/457 X |
| 3,205,678 | 9/1965 | Stoner | 62/457 |
| 3,282,068 | 11/1966 | Cain | 62/457 |
| 3,302,428 | 2/1967 | Stoner et al. | 62/457 |
| 3,360,957 | 1/1968 | Paquin | 62/457 |
| 3,743,130 | 7/1973 | Jorgensen | 62/372 |
| 3,995,445 | 12/1976 | Huskins | 62/371 |
| 4,037,428 | 7/1977 | Giannotti | 62/371 |

FOREIGN PATENT DOCUMENTS

| | | | |
|---|---|---|---|
| 150319 | 10/1952 | Austria | 62/372 |
| 72074 | 2/1893 | Fed. Rep. of Germany | 62/372 |

*Primary Examiner*—Lloyd L. King

*Attorney, Agent, or Firm*—Thorpe, North & Western

[57] ABSTRACT

A server for chilled wine and similar beverages or foods includes a generally cylindrically-shaped side wall into which a bottle or other container may be placed. The side wall is constructed of a heat conductive material such as aluminum, copper, alloys thereof, etc., of sufficient thickness to conduct heat as needed in its circumferential direction. The server also includes an ice receptacle formed to surround a side portion of the side wall to hold ice in contact with the side wall. The side wall acts to present the wine container with a surface which is at or below the temperature of the wine. This substantially eliminates the transfer of heat by radiation to the wine container. The server also minimizes conductive and/or convective heat transfer between the wine bottle and the surroundings.

4 Claims, 4 Drawing Figures

SERVER FOR WINE BOTTLES AND THE LIKE

This application is a continuation of application Ser. No. 171,901, filed July 24, 1980, now abandoned which was a continuation-in-part of application, Ser. No. 61,655, 7/30/79 now U.S. Pat. No. 4,255,944.

BACKGROUND OF THE INVENTION

This invention relates to a server construction for efficiently and conveniently maintaining the temperature of chilled wine or other beverage or food in a container.

The conventional way to either chill wine or maintain the coldness of wine while the wine bottle sits on a table, counter, etc., is to place the wine bottle in an ice bucket filled with ice and water. Typically, a cloth napkin is also placed over the wine bottle. This method, although effective, is messy because ice must be heaped about the bottle, and the bottle and bottle label are made wet, become slippery, and may drip on the table or counter top when removed from the ice bucket. Also, the ice bucket is quite bulky and cumbersome to handle.

A number of proposals have been made for improving upon the abovedescribed methods of serving chilled wine or other beverage, and some of these are discussed in U.S. Pat. Nos. 2,564,165, 3,302,428, 2,068,384, 4,037,428, 1,999,670, 3,282,068 and French Pat. No. 1,127,267. These proposals, however, generally either are not very effective in maintaining the beverage in the chilled condition over desired extended periods, are still bulky and cumbersome, require prechilling of the cooling device and placement of the cooling medium about the bottle, or generally have the same disadvantages as does the conventional wine cooler or ice bucket. Chilling wine or other beverage, of course, can easily be accomplished by placing the bottles in the refrigerator some hours before serving. What has been needed is a convenient, compact, attractive, immediately effective, and mess-free arrangement for maintaining the wine at the table or bar at the refrigerator temperature over periods of time of up to two hours.

SUMMARY OF THE INVENTION

It is an object of the invention to provide a new and improved server for chilled wine bottles and similar beverage containers.

It is also an object of the invention to provide a server which will cool or maintain the low temperature of a beverage bottle without making the bottle wet.

It is a further object of the invention to provide a compact attractive server for beverage bottles.

It is an additional object of the invention to provide an effective radiant heat shield for intercepting radiant heat and conducting it to a remote ice sink.

The above and other objects are realized in a specific illustrative embodiment of a server which includes a housing open at the top for receiving a bottle to be cooled and having a side wall shaped to conform to and surround the side exterior of the bottle. The height of the side wall is at least about the same as the height of the enlarged portion of a typical beverage bottle so that when the bottle is placed in the housing, the side wall substantially surrounds the bottle. The side wall is made of a heat conductive material such as aluminum, copper, silver, etc., of sufficient thickness to conduct heat as needed in its circumferential direction. The server also includes a receptacle formed on one side of the housing for holding ice in contact with the side wall. The side wall is thus cooled by the ice in the receptacle to thereby present to the bottle a surface area at or below the desired serving temperature. Radiative heat transfer to the bottle is thus generally prevented, and the trapped air layer between the side wall and the bottle inhibits conductive or convective heat transfer to the bottle. In this manner, the bottle may be maintained at close to a refrigerator temperature for fairly long periods of time or, if the bottle is initially warmer than refrigerator temperatures, it can be slowly cooled. This is accomplished with a very compact, esthetically pleasing structure.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Various embodiments of the present invention are shown in the accompanying drawings and will be described herein. The common features of the embodiment are the employment of a housing having a side wall for surrounding a bottle to be maintained cool or cooled, and the provision of an ice receptacle for holding ice in contact with the side wall. The side wall is made of a thick piece of heat conducting material such as aluminum, copper, silver, etc., which facilitates conducting heat originating either from the bottle or from the surrounding environment to the ice to thereby cool the bottle or interfere and inhibit radiant heat from reaching the bottle. In this fashion, a bottle of wine or similar beverage may be effectively maintained at a cool temperature without the attendant mess associated with the conventional ice bucket cooling server proposals.

Figure 1:
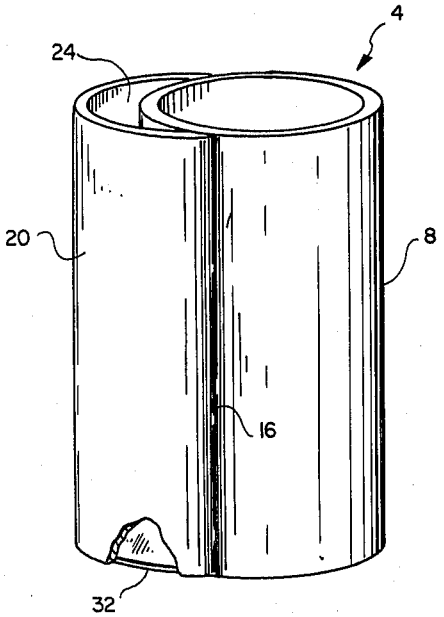
FIG. 1 is a perspective view of a server made in accordance with the principles of the present invention.
Figure 2:
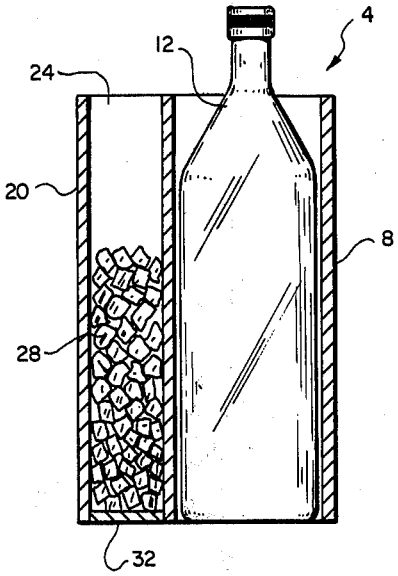
FIG. 2 is a side, cross-sectional view of the server of FIG. 1.

Referring now to FIGS. 1 and 2, there is shown a perspective view and side, cross-sectional view respectively of a server housing 4 which includes a fairly thick-walled cylindrical side wall 8 which is open at the top to allow placement therein of a bottle of wine 12 or similar beverage container. The cylinder 8 is made of a heat conducting material such as aluminum, copper, silver, etc., for purposes to be described hereinafter.

Projecting outwardly from the exterior surface of the side wall 8 along a generally vertical line 16 and curving about a portion of the side wall to again join the exterior surface of the side wall is an outer wall 20. The outer wall 20, which is substantially the same height as the side wall 8 in the embodiment of FIGS. 1 and 2, forms a receptacle with a space 24 between the side wall 8 and outer wall 20 for receiving ice 28. A bottom wall 32 joins the bottoms of the outer wall 20 and a portion of the side wall 8 to support and maintain ice in the space 24. The outer wall 20 and bottom wall 32 may, but need not be, constructed of the same conductive material as that of the housing 4.

The bottom of the housing 4 may either be open (as shown in the drawings), in which case the bottle of wine 12 would be placed directly on the surface supporting the server, or closed with a bottom wall, in which case the bottle would be placed on such bottom wall.

In use, ice 28 is placed in the space 24 defining the ice receptacle and a bottle to be cooled or whose temperature is to be maintained cool is placed in the housing 4. The side wall 8 intercepts radiant heat from the room and conducts the heat about the wall to the ice receptacle. Heat from the bottle which radiates to the side wall 8 will similarly be conducted to the ice 28.

Illustrative dimensions for the housing 4 of FIGS. 1 and 2 are as follows:

Outside diameter of cylinder 8: 4 inches

Thickness of wall of cylinder 8: 0.125 inches

Height of the housing 4: 7¾ inches

For a server made in accordance with the present invention and having the above-defined dimensions, it has been found that for a bottle of wine which extends about 3¾ inches above the top of the housing 4 when placed in the housing and has an initial temperature of about 40 degrees Fahrenheit, the average rise in temperature for the contents of the bottle is about 1 degree F. in the first hour and another degree F. in the second hour. This result was accomplished with an ambient room temperature of about 70 degrees F.

For best results, the height of the housing 4 should be sufficient so that the cylinder 8 substantially surrounds the bottle or at least the enlarged portion of a typical bottle (excluding the neck). Of course, the server still will inhibit the rise in temperature of a bottle of wine placed in the server even if the cylinder 8 leaves a portion of the bottle exposed above the top thereof.

Figure 3:
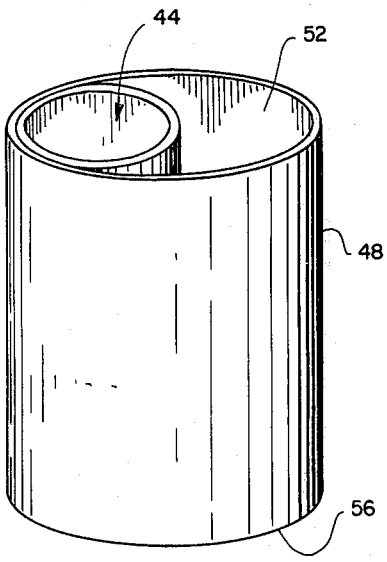
FIG. 3 is a perspective view of another embodiment of the present invention wherein an interior housing is circumscribed by an exterior jacket.

FIG. 3 shows a perspective view of another embodiment of the server of the present invention. This embodiment includes a cylindrical housing 44 for receiving a beverage bottle. The housing 44 is made of a heat conductive material. Circumscribing the housing 44 is an outer wall jacket 48 whose top cross-section is oblong or elliptical. The housing 44 is disposed in one end of the elliptical outer wall formation so that a portion of the side wall of the housing is in contact with and joined to a portion of the interior surface of the jacket 48 as shown. The outer wall 48 could be made of a heat conducting material or, alternatively, a non-heat conducting material such as plastic or other synthetic material.

A receptacle space 52 is defined between the housing 44 and the outer wall 48 at the other end of the eliptical outer wall formation to receive ice for the same purpose as described for the FIGS. 1 and 2 embodiment. A bottom wall 56 for this receptacle space is provided to support the ice.

Figure 4:
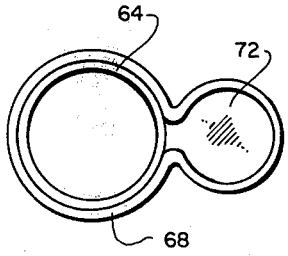
FIG. 4 is a top view of still another embodiment of the present invention in which the exterior jacket is pinched at its narrow width.

FIG. 4 shows a top plan view of still another embodiment of the server in which a heat conductive cylindrical housing 64 is again circumscribed by an outer wall jacket 68. The outer wall 68 is pinched at its narrow width to form a top cross-section similar in shape to the numeral 8. One loop of the outer wall 68 defines a receptacle space 72 for receiving ice. A bottom wall is provided at the bottom edge of the outer wall 68 which defines the receptacle space 72 to hold the ice.

All of the embodiments described are compact, esthetically attractive and easy to construct. Each includes a generally cylindrical housing constructed of a heat conductive material to conduct heat to ice held in a receptacle formed to one side of the housing.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A server for wine bottles and the like comprising a vertically elongate housing open at the top for receiving a bottle and having a side wall for surrounding the entire side exterior of the bottle, said side wall constructed of a heat conductive material to enable complete circumferential conduction in the side wall, and receptacle means for holding ice in contact with a side portion of the exterior of said side wall, said receptacle including an outer wall surrounding said side portion of the side wall to define a space therebetween for receiving ice, said outer wall being joined to the side wall at a first generally vertical locus of points, and then looping outwardly from the first locus and about said space, and joining the side wall at a second generally vertical locus of points spaced horizontally from the first locus, and a bottom wall joining the bottoms of the outer wall and side wall to support ice placed in said space.

2. A server as in claim 1 wherein said vertical exterior housing is cylindrical in shape, and wherein said outer wall is semi-cylindrical in shape.

3. A server as in claim 2 wherein said housing and outer wall is constructed of extruded aluminum.

4. A server as in claim 2 wherein said housing is constructed of aluminum, and said outer wall is constructed of plastic or like material.

* * * * *